US010380819B2

(12) United States Patent
Shimizu et al.

(10) Patent No.: US 10,380,819 B2
(45) Date of Patent: Aug. 13, 2019

(54) MONEY HANDLING MACHINE, MONEY HANDLING SYSTEM AND MONEY HANDLING METHOD

(71) Applicant: GLORY LTD., Hyogo (JP)

(72) Inventors: Kazuyuki Shimizu, Hyogo (JP); Isamu Kouno, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 15/943,166

(22) Filed: Apr. 2, 2018

(65) Prior Publication Data

US 2018/0286163 A1 Oct. 4, 2018

(30) Foreign Application Priority Data

Apr. 4, 2017 (JP) ..... 2017-074367

(51) Int. Cl.

| | |
|---|---|
| ***G07D 1/00*** | (2006.01) |
| ***G07D 11/125*** | (2019.01) |
| ***G07D 11/245*** | (2019.01) |
| ***G07C 9/00*** | (2006.01) |
| ***G07D 9/00*** | (2006.01) |
| ***G07D 11/13*** | (2019.01) |
| ***G07D 11/16*** | (2019.01) |
| *G07D 7/181* | (2016.01) |

(52) U.S. Cl.

CPC ..... *G07D 9/006* (2013.01); *G07C 9/00912* (2013.01); *G07D 1/00* (2013.01); *G07D 11/125* (2019.01); *G07D 11/13* (2019.01); *G07D 11/16* (2019.01); *G07D 11/245* (2019.01); *G07D 7/181* (2017.05); *G07D 2201/00* (2013.01); *G07D 2207/00* (2013.01); *G07D 2211/00* (2013.01)

(58) Field of Classification Search

CPC ..... G07D 11/245; G07D 1/00; G07D 11/16; G07D 11/125

See application file for complete search history.

(56) References Cited

U.S. PATENT DOCUMENTS 6,283,324 B1 * 9/2001 Jenkins ..... B65G 1/08 221/192
6,378,770 B1 * 4/2002 Clark ..... G07D 11/245 235/379
6,550,671 B1 * 4/2003 Brown ..... G07D 11/0087 235/379

(Continued)

FOREIGN PATENT DOCUMENTS

JP 5902667 4/2016

OTHER PUBLICATIONS

Extended European Search Report for EP 18165669.5 dated Jul. 27, 2018.

*Primary Examiner* — Daniel I Walsh
(74) *Attorney, Agent, or Firm* — Greenblum & Bernstein, P.L.C.

(57) ABSTRACT

A money handling machine (for example, a money depositing/dispensing machine 100) includes: a coin-roll storage unit (for example, a coin-roll storage device 180) configured to store a coin roll; an authentication unit 107 configured to authenticate an authority of an operator; and a controlling unit 102 configured to control the coin-roll storage unit so as to dispense the coin roll to replenish a plurality of settlement places 20 at a time only when the authority of the operator authenticated by the authentication unit 107 is a predetermined authority.

16 Claims, 8 Drawing Sheets

(56) References Cited

U.S. PATENT DOCUMENTS 6,761,308 B1 * 7/2004 Hanna ..... G06Q 20/1085 235/379
6,772,941 B1 * 8/2004 Carter ..... G07D 9/04 177/25.15
7,419,090 B2 * 9/2008 Sawa ..... G07F 9/026 235/379
7,850,076 B1 * 12/2010 Dorenbaum ..... G07D 11/40 235/381
8,117,127 B1 * 2/2012 Sanders ..... G06Q 20/1085 705/30
8,640,945 B1 * 2/2014 McCormick ..... G07D 1/02 235/379
10,157,515 B2 * 12/2018 Brancaccio ..... G06Q 20/1085
2002/0053594 A1 * 5/2002 Haney ..... B65H 5/025 235/381
2002/0152141 A1 * 10/2002 Carter ..... G06Q 20/20 705/29
2004/0016796 A1 * 1/2004 Hanna ..... G06Q 20/105 235/375
2004/0231955 A1 * 11/2004 Carter ..... G07D 9/00 194/217
2005/0017066 A1 * 1/2005 Carter ..... G06Q 10/06398 235/375
2005/0211762 A1 * 9/2005 Dodson ..... G06Q 20/20 235/379
2006/0065717 A1 * 3/2006 Hurwitz ..... G06Q 10/087 235/381
2007/0124021 A1 * 5/2007 Smith ..... G07D 1/00 700/231
2008/0265019 A1 * 10/2008 Artino ..... G06Q 20/1085 235/379
2009/0071793 A1 * 3/2009 Nagase ..... G07D 1/02 194/215
2009/0101723 A1 * 4/2009 Uehara ..... G06Q 20/102 235/7 A
2009/0171498 A1 * 7/2009 Tabata ..... G07D 1/02 700/214
2009/0320538 A1 * 12/2009 Pellaton ..... G07C 9/00166 70/278.1
2010/0108576 A1 * 5/2010 Wada ..... G07D 11/0084 209/534
2010/0127070 A1 * 5/2010 Sanders ..... G07F 19/20 235/379
2010/0200448 A1 * 8/2010 Doi ..... G07D 9/00 206/459.1
2010/0312377 A1 * 12/2010 Iwata ..... G07D 1/00 700/219
2011/0015777 A1 * 1/2011 Akamatsu ..... G07D 9/00 700/214
2011/0030312 A1 * 2/2011 Wonka ..... G07D 1/00 53/167
2011/0295741 A1 * 12/2011 Sugitani ..... G06Q 20/10 705/39
2012/0173352 A1 * 7/2012 Doi ..... G06Q 20/20 705/18
2013/0024304 A1 * 1/2013 Doi ..... G07G 1/0036 705/16
2013/0332295 A1 * 12/2013 Araki ..... G06Q 40/02 705/21
2014/0060997 A1 * 3/2014 Doi ..... G07F 9/06 194/206
2014/0069769 A1 * 3/2014 Kobayashi ..... G07D 11/00 194/206
2014/0080395 A1 * 3/2014 Takeuchi ..... G07D 1/00 453/3
2014/0124573 A1 * 5/2014 Doi ..... G07F 19/202 235/379
2014/0166432 A1 * 6/2014 Saiki ..... G07D 7/00 194/206
2014/0318925 A1 * 10/2014 Lee ..... G07F 19/202 194/206
2015/0213667 A1 * 7/2015 Chugo ..... G07D 11/50 700/223
2016/0284151 A1 * 9/2016 Fujimura ..... G07D 1/04
2017/0066600 A1 * 3/2017 Nakanishi ..... B65G 47/49
2017/0140597 A1 * 5/2017 Takami ..... G07D 1/02
2017/0278332 A1 * 9/2017 Nader ..... G07D 9/006
2018/0005481 A1 * 1/2018 Nakanishi ..... B65H 3/042
2018/0260911 A1 * 9/2018 Kataoka ..... G06Q 40/02
2018/0286163 A1 * 10/2018 Shimizu ..... G07D 9/006
2018/0350183 A1 * 12/2018 Sato ..... G07D 9/00
2018/0365938 A1 * 12/2018 Honda ..... G07G 1/12
2019/0026970 A1 * 1/2019 Doi ..... G07D 1/00
2019/0073854 A1 * 3/2019 Machida ..... G07G 1/00

* cited by examiner

MONEY HANDLING MACHINE, MONEY HANDLING SYSTEM AND MONEY HANDLING METHOD

CROSS-REFERENCE TO RELATED APPLICATION

This application claims priority to Japanese Patent Application No. 2017-074367 filed on Apr. 4, 2017, the entire contents of which are incorporated herein by reference.

BACKGROUND OF THE INVENTION

1. Field of the Invention

The present invention relates to a money handling machine that handles money such as banknotes, coins, coin rolls and the like, a money handling system that includes the money handling machine, and a money handling method performed by the money handling machine.

2. Description of the Related Art

In a store such as a supermarket, convenience store and the like, a money change machine is installed in a settlement place of a front area where merchandise-shelves are installed, and a depositing/dispensing machine such as a teller machine is installed in a back office area where customers can not enter. The money change machine installed in the settlement place of the front area can perform deposit process of the money handed from the customer to a cashier in exchange for the merchandises, and can perform dispense process of the money as a change. The depositing/dispensing machine such as the teller machine installed in the back office area performs deposit process of the money as a sales proceeds collected from the money change machine, and can perform dispense process of the money as a change replenishment money to replenish the money change machine. As such a money handling system, for example, one disclosed in Japanese Patent No. 5902667 and the like is conventionally known. In the money handling system as disclosed in Japanese Patent No. 5902667 and the like, banknotes are delivered between the money change machine and the depositing/dispensing machine by a banknote storage cassette. Specifically, the banknote storage cassette stores the banknotes sent from an inside of the money change machine and depositing/dispensing machine, for example in a stacked state, when mounted on the money change machine or depositing/dispensing machine, and feeds out the stored banknotes one by one to send them toward the inside of the money change machine and depositing/dispensing machine. On the other hand, when replenishing coin rolls as a change fund to the money change machine, the cashier of the settlement place carries the coin rolls dispensed from the depositing/dispensing machine to the money change machine by hand by putting them in a storage case and the like.

SUMMARY OF INVENTION

As described above, when replenishing the coin rolls as the change fund to the money change machine, if the cashier of the settlement place carries the coin rolls stored in the storage case and the like to the money change machine by hand, since the coin rolls are put in the storage case and the like by the hand of the cashier and are carried from the back office area to the settlement place of the front area with the storage case and the like by the cashier, there was a problem in terms of security.

The present invention has been made in view of these points, and it is an object of the present invention to provide a money handling machine, money handling system and money processing method capable of improving security compared to a case where the cashier of the settlement place dispenses the coin rolls, because only a person having a predetermined authority such as a manager can dispense the coin rolls and sort the dispensed coin rolls for each settlement place.

A money handling machine of the present invention includes: a coin-roll storage unit configured to store a coin roll; an authentication unit configured to authenticate an authority of an operator; and a controlling unit configured to control the coin-roll storage unit so as to dispense the coin roll to replenish a plurality of settlement places at a time only when the authority of the operator authenticated by the authentication unit is a predetermined authority.

In the money handling machine of the present invention, the coin-roll storage unit may include a storage portion in which the coin roll is stored and a lock mechanism configured to lock the storage portion inside a casing, and the controlling unit may control the lock mechanism so as to release the lock of the storage portion only when the authority of the operator authenticated by the authentication unit is the predetermined authority.

The money handling machine of the present invention may further include a receiving unit configured to receive information on the coin roll to replenish each of the plurality of settlement places, and the controlling unit may calculate a total number of the coin roll to replenish each of the plurality of settlement places based on the information received by the receiving unit.

In addition, the money handling machine of the present invention may further include a cassette mounting unit on which at least one of a plurality of storage cassettes is detachably mounted, each of the plurality of storage cassettes stores money in a separate state and feeds out the money to be stored, each of the plurality of storage cassettes may correspond to each of the plurality of settlement places, each of the plurality of storage cassettes may be provided with a storage medium for storing the information on the coin roll to replenish the corresponding settlement place, and the receiving unit may receive the information on the coin roll to replenish each of the plurality of settlement places based on the information read from the storage medium of each of the plurality of storage cassettes.

Furthermore, the controlling unit may output the total number of the coin roll.

The money handling machine of the present invention may further include a detecting unit configured to detect the number of coin rolls dispensed from the coin-roll storage unit; and a first judging unit configured to judge whether the number of coin rolls dispensed from the coin-roll storage unit based on a detection result by the detecting unit coincides with the total number of the coin roll to replenish each of the plurality of settlement places calculated by the controlling unit.

In this case, the controlling unit may output a warning information when it is judged by the first judging unit that the number of coin rolls dispensed from the coin-roll storage unit based on the detection result by the detecting unit does not coincide with the total number of the coin roll to replenish each of the plurality of settlement places calculated by the controlling unit.

The money handling machine of the present invention may further include a detecting unit configured to detect the number of coin rolls dispensed from the coin-roll storage unit, and the controlling unit may output information about the coin roll dispensed from the coin-roll storage unit based on detection result by the detecting unit.

In this case, the controlling unit may output the information about the coin roll dispensed from the coin-roll storage unit for each of the plurality of settlement places.

The money handling machine of the present invention may further include a printing unit configured to print the information output by the controlling unit about the coin roll dispensed from the coin-roll storage unit.

A money handling system of the present invention includes a money handling machine that includes a coin-roll storage unit configured to store a coin roll; a plurality of settlement apparatuses, a settlement apparatus being installed in each of a plurality of settlement places and configured to be replenished by the coin roll dispensed from the money handling machine; a plurality of management apparatuses, a management apparatus being installed in each of the plurality of settlement places and configured to manage the corresponding settlement apparatus; and an authentication unit configured to authenticate an authority of an operator and a controlling unit configured to control the coin-roll storage unit of the money handling machine so as to dispense the coin roll to replenish the plurality of settlement places only when the authority of the operator authenticated by the authentication unit is a predetermined authority are respectively provided.

In the money handling system of the present invention the authentication unit may be provided in at least one of the settlement apparatus and management apparatus.

The money handling system of the present invention may further include a second judging unit configured to judge whether the total number of the coin roll to replenish each settlement apparatus coincides with the number of coin rolls dispensed from the money handling machine.

In this case, the second judging unit may be provided in at least one of the settlement apparatus and management apparatus.

A money handling method of the present invention that is performed by a money handling machine that includes a coin-roll storage unit configured to store a coin roll includes the steps of: authenticating an authority of an operator; and only if the authenticated authority of the operator is a predetermined authority, then controlling the coin-roll storage unit so as to dispense the coin roll to replenish a plurality of settlement places at a time.

DESCRIPTION OF THE PREFERRED EMBODIMENTS

Figure 1:
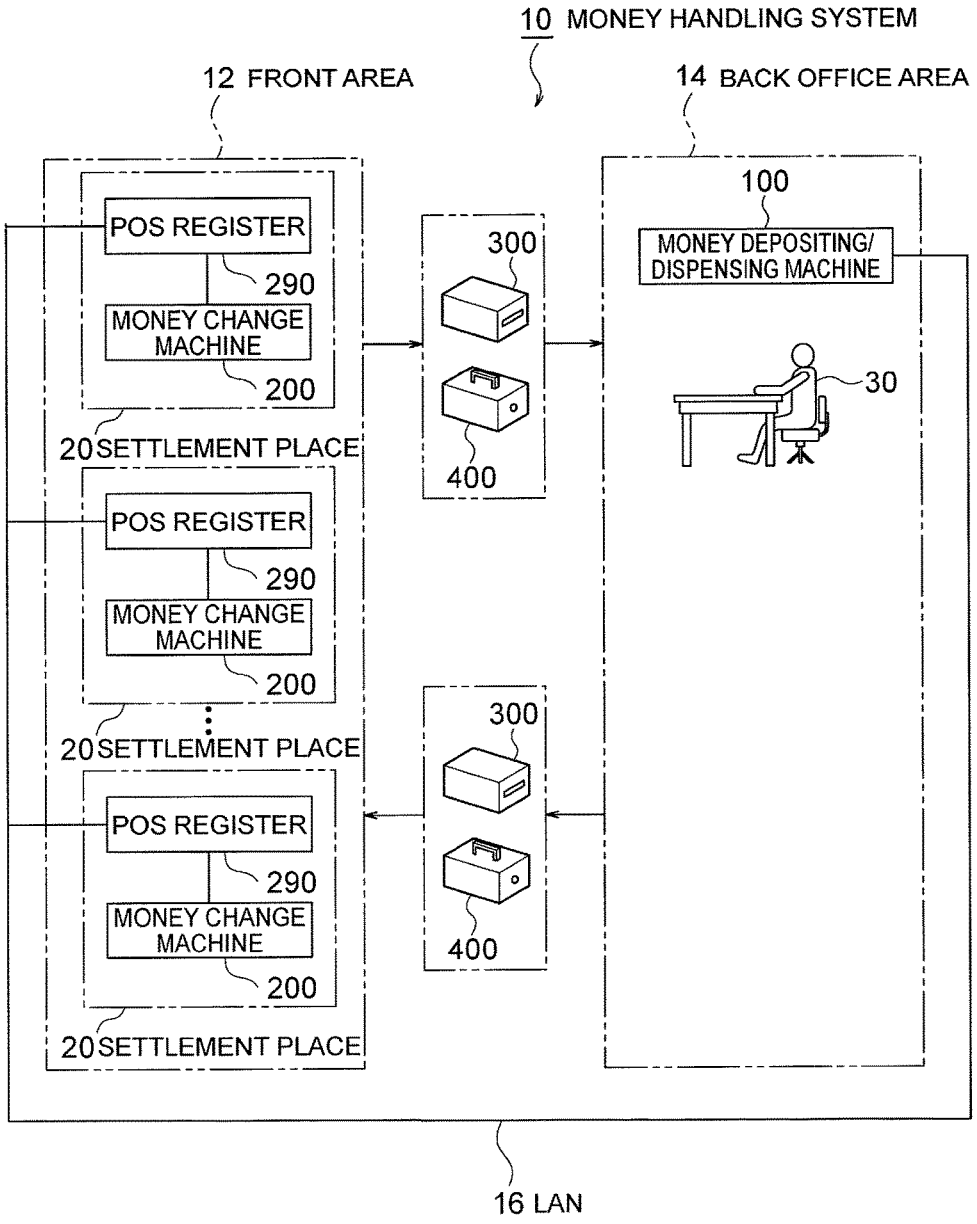
FIG. 1 is a schematic configuration diagram for schematically explaining a configuration of a money handling system according to an embodiment of a present invention.
Figure 2:
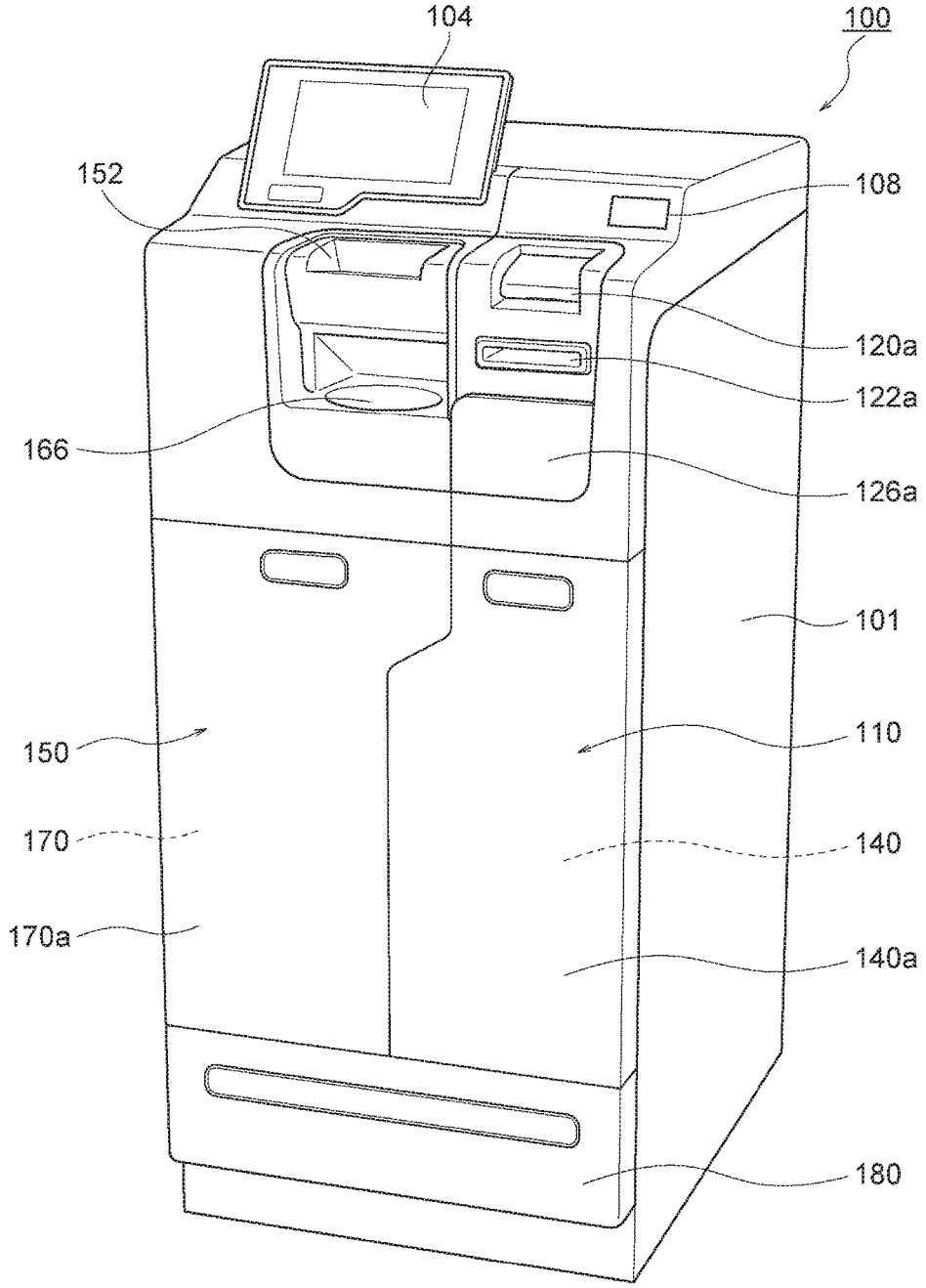
FIG. 2 is a perspective view showing an appearance of a money depositing/dispensing machine in the money handling system shown in FIG. 1.
Figure 3:
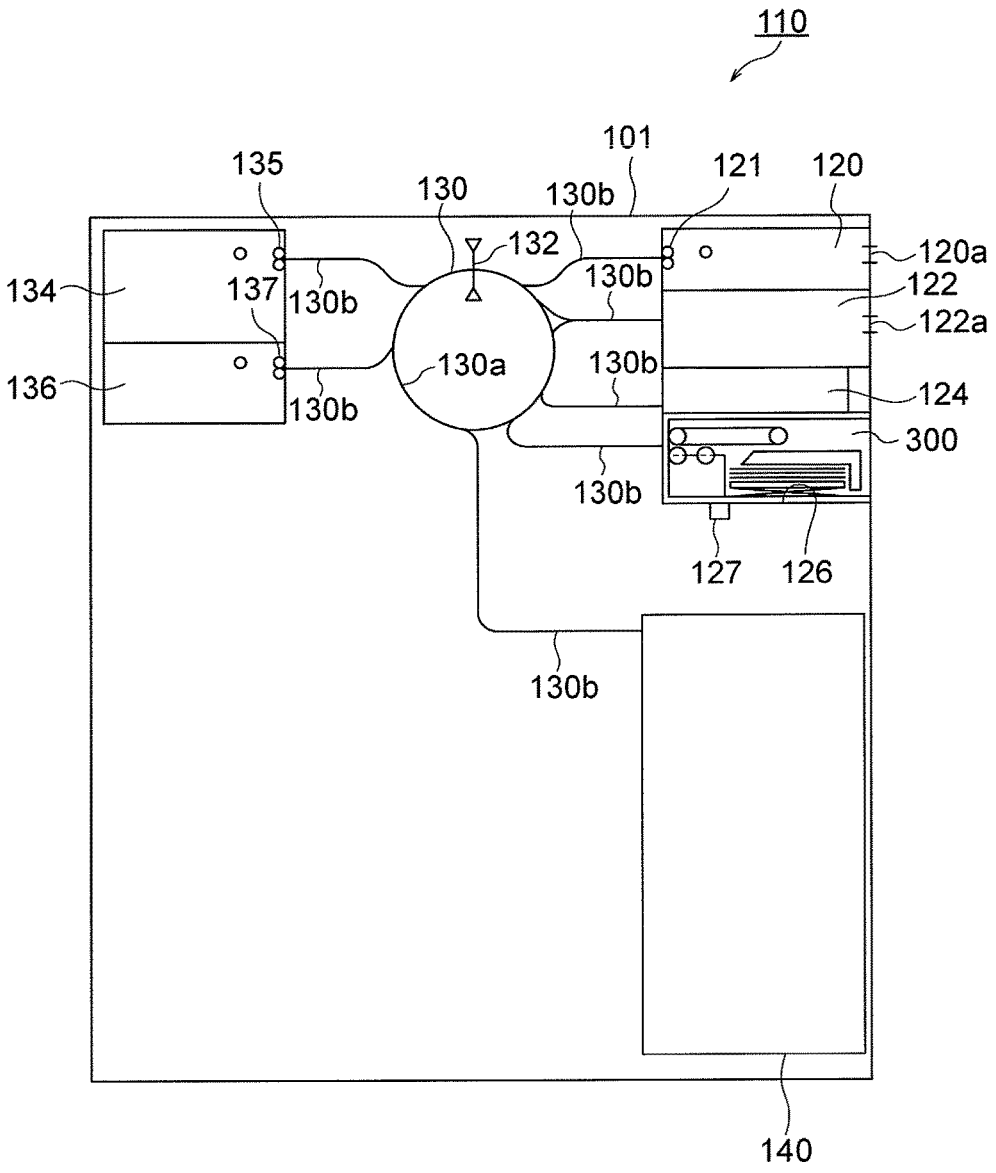
FIG. 3 is a configuration diagram of an internal configuration of a banknote handling device in the money depositing/dispensing machine shown in FIG. 2 as seen from the side.
Figure 4:
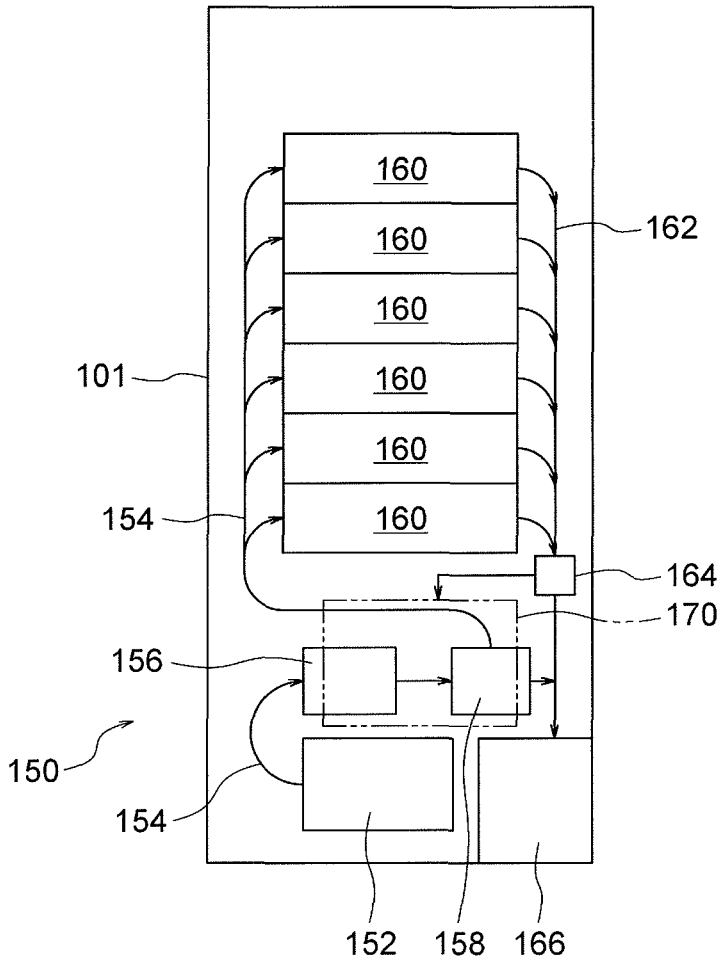
FIG. 4 is a configuration diagram of an internal configuration of a coin handling device in the money depositing/dispensing machine shown in FIG. 2 as seen from above.
Figure 5:
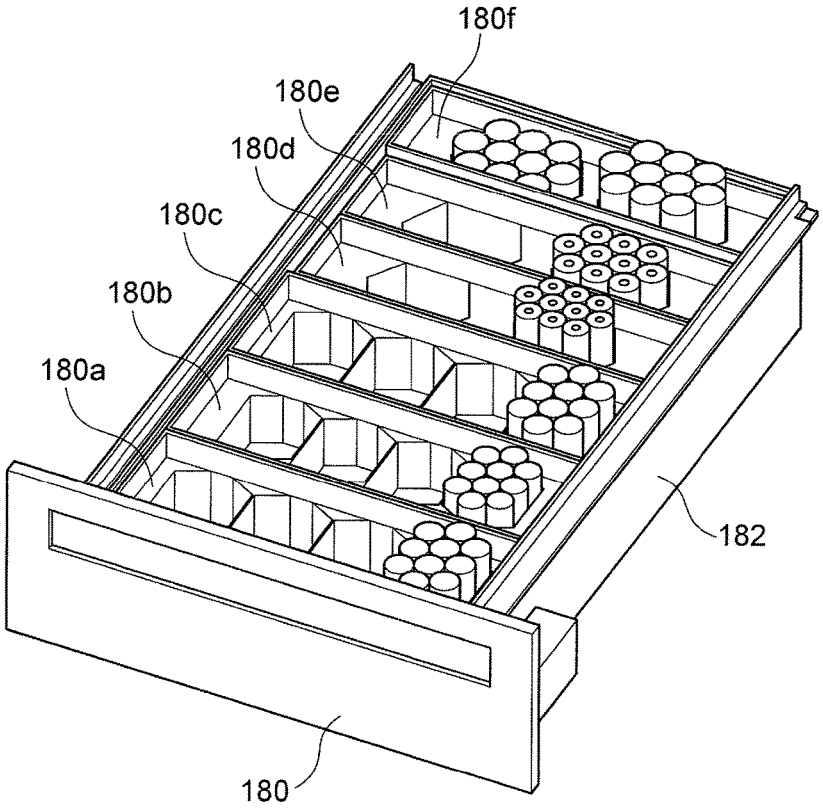
FIG. 5 is a perspective view showing a configuration of a drawer of a coin-roll storage device in the money depositing/dispensing machine shown in FIG. 2.
Figure 6:
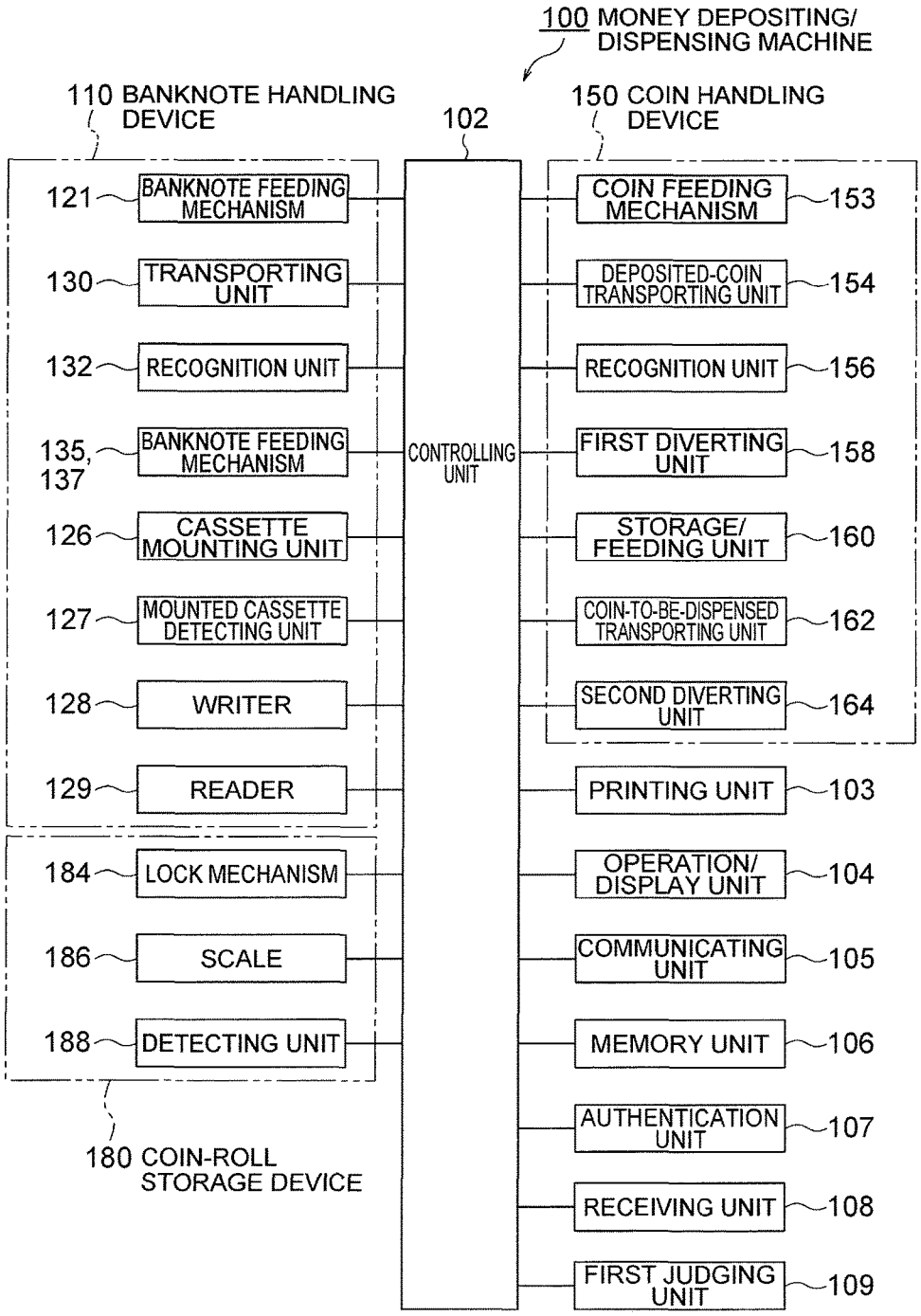
FIG. 6 is a functional block diagram showing a configuration of a control system in the money depositing/dispensing machine shown in FIG. 2.
Figure 7:
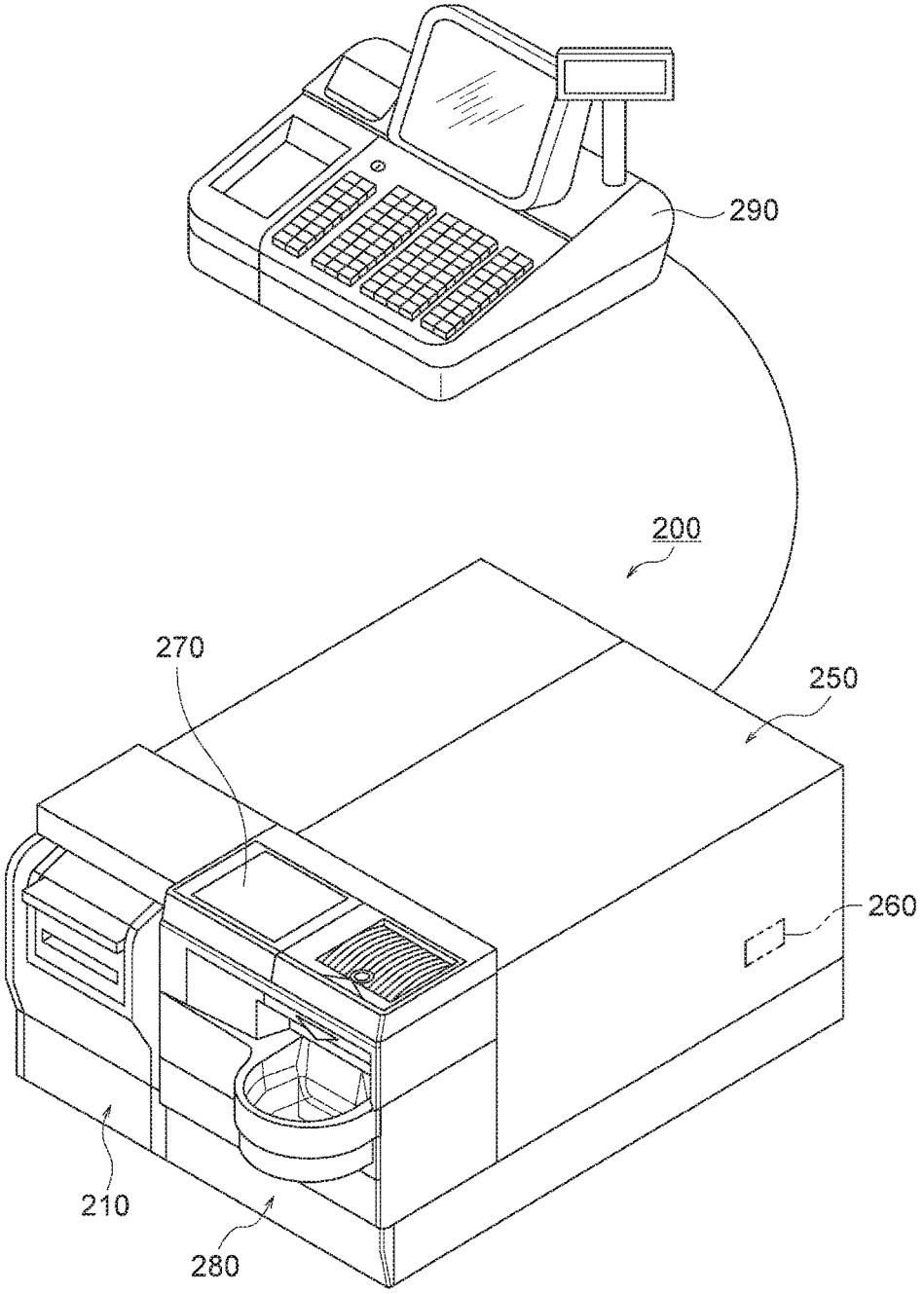
FIG. 7 is a perspective view showing an external appearance of a money change machine and a POS register in the money handling system shown in FIG. 1.
Figure 8:
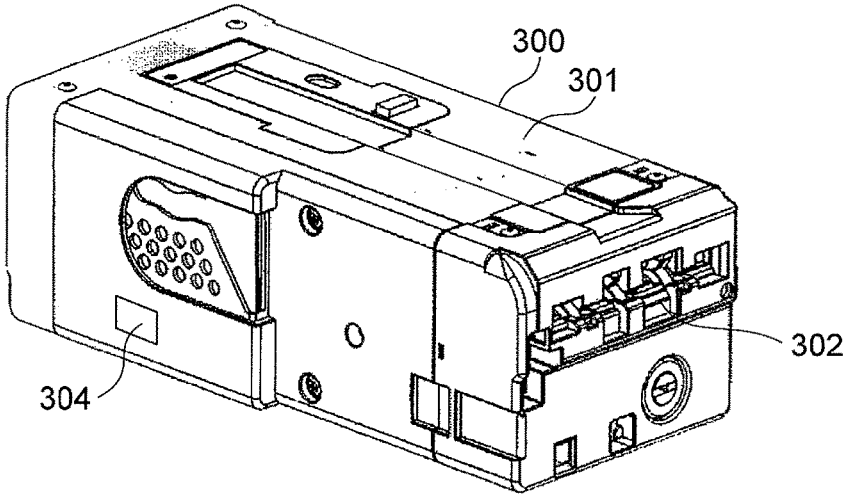
FIG. 8 is a perspective view showing an external appearance of a storage cassette that can be detachably mounted on a cassette mounting unit of the money depositing/dispensing machine and a cassette mounting unit of the money change machine in the money handling system shown in FIG. 1.

Hereinafter, an embodiment of the present invention will be described with reference to the drawings. FIG. 1 to FIG. 8 illustrate a money handling system according to a present embodiment and a money depositing/dispensing machine provided in such a money handling system. Among them, FIG. 1 is a schematic configuration diagram for schematically explaining a configuration of the money handling system according to the present embodiment and FIG. 2 is a perspective view showing an appearance of a money depositing/dispensing machine in the money handling system shown in FIG. 1. Furthermore, FIGS. 3 to 5 are diagrams showing configurations of a banknote handling device, a coin handling device and a coin-roll storage device in the money depositing/dispensing machine shown in FIG. 2, respectively. Furthermore, FIG. 6 is a functional block diagram showing a configuration of a control system in the money depositing/dispensing machine shown in FIG. 2. Furthermore, FIG. 7 is a perspective view showing an external appearance of a money change machine and a POS register in the money handling system shown in FIG. 1 and FIG. 8 is a perspective view showing an external appearance of a storage cassette that can be detachably mounted on a cassette mounting unit of the money depositing/dispensing machine and a cassette mounting unit of the money change machine in the money handling system shown in FIG. 1.

As shown in FIG. 1, in a store of a commercial facility such as a convenience store, a supermarket and the like, merchandise-shelves on which various merchandises are displayed are installed in a front area 12 where a customer can enter. In addition, a plurality of settlement places 20 (specifically, for example, face-to-face register counters) are provided in the front area 12. As shown in FIG. 1, a money change machine 200 and a POS register 290 are installed in each of a plurality of settlement places 20, and a cashier of the store operates these money change machines 200 and POS registers 290. When the customer performs a settlement process in such a settlement place 20, the cashier deposits the money for the merchandises received from the customer to the money change machine 200, and dispenses the money as a change from the money change machine 200 and returns it to the customer. The POS register 290 manages information on the merchandises purchased by the customer, information on money stored in the money change machine 200, and the like.

A money depositing/dispensing machine 100 such as an teller machine for depositing the money as a sales proceeds collected from each money change machine 200 is installed in a back office area 14 (for example, a cash room), where the customer is prohibited from entering, in the store. Such money depositing/dispensing machine 100 can perform deposit process of the money as the sales proceeds collected from the money change machine 200. In the case where the money as the change is insufficient in the money change machine 200, the money can be dispensed as a change replenishment money from the money depositing/dispensing machine 100, and as a result, the money as the change replenishment money dispensed from the money depositing/dispensing machine 100 can be replenished to the money change machine 200. In a money handling system 10 according to the present embodiment, from the money depositing/dispensing machine 100, a collection cassette 140, 170 (to be described later) in which the banknotes or coins are stored is taken out by a security officer and the like of a security company, and the banknotes and coins stored in the collection cassette 140, 170 are collected from the money depositing/dispensing machine 100 to the security company together with the collection cassette 140, 170. The security officer of the security company carries the money as a change fund to be used in the money change machine 200 from the security company to the store, and deposits the money as the change fund to the money depositing/dispensing machine 100 provided in the back office area 14 of this store.

In the back office area 14, a manager 30 performs the task of sorting coin rolls dispensed from the money depositing/dispensing machine 100 for each of the plurality of settlement places 20. Details of the work of the manager 30 will be described later.

As shown in FIG. 1, each POS register 290 installed in the front area 12 and the money depositing/dispensing machine 100 installed in the back office area 14 are communicably connected via a LAN 16. Instead of communicatively connecting each POS register 290 and the money depositing/dispensing machine 100 via the LAN 16, or in addition to communicably connecting each POS register 290 and the money depositing/dispensing machine 100 via the LAN 16, each money change machine 200 installed in the front area 12 and the money depositing/dispensing machine 100 installed in the back office area 14 may be communicatively connected via the LAN 16.

In the present embodiment, the money handling system 10 is configured by combining such money depositing/dispensing machine 100, each money change machine 200 and each POS register 290.

Next, the configuration of the money depositing/dispensing machine 100 in such money handling system 10 will be described in detail with reference to FIGS. 2 to 6.

As shown in FIG. 2 and the like, the money depositing/dispensing machine 100 according to the present embodiment is provided with a substantially rectangular parallelepiped housing 101. Inside the housing 101, there are provided a banknote handling device 110 for depositing and dispensing the banknotes (banknotes in a separate state), a coin handling device 150 for depositing and dispensing the coins (coins in a separate state) and a coin-roll storage device 180 that stores the coin rolls (each coin roll is packed with a film, wrapping paper or the like in a bar shape with a certain number (for example, 20 or 50) of coins of the same denomination). As shown in FIG. 2, the banknote handling device 110 and the coin handling device 150 are arranged so as to line up on the left and right, viewed from the front side of the money depositing/dispensing machine 100. Furthermore, the coin-roll storage device 180 is arranged below these banknote handling device 110 and coin handling device 150.

As shown in FIGS. 2 and 3, the banknote handling device 110 includes a banknote receiving unit 120 provided in a right area on the front side of the housing 101, a banknote dispensing unit 122 provided below the banknote receiving unit 120 on the front side of the housing 101, a transporting unit 130 for transporting the banknotes one by one inside the housing 101, and a plurality of banknote storage units 134, 136 for storing the banknotes inside the housing 101 and capable of feeding out the stored banknotes. In FIG. 3, a right side of the housing 101 is the front side of the banknote handling device 110, and the leftward direction in FIG. 3 is a depth direction of the banknote handling device 110. As shown in FIG. 3, the transporting unit 130 is composed of a round transporting unit 130*a* disposed at a center of the upper part of the housing 101 and a plurality of connection transporting units 130*b*. The banknote receiving unit 120, the banknote dispensing unit 122, a dispense rejecting unit 124, a cassette mounting unit 126 on which a storage cassette 300 (to be described later) can be detachably mounted, the collection cassette 140 and the two banknote storage units 134 and 136 are arranged so as to surround the round transporting unit 130*a*, respectively. In addition, as shown in FIG. 3, each of the plurality of connection transporting units 130*b* connects each of the banknote receiving unit 120, the banknote dispensing unit 122, the dispense rejecting unit 124, the cassette mounting unit 126, the collection cassette 140 and each of the banknote storage units 134 and 136 to the round transporting unit 130*a*, respectively. A recognition unit 132 is provided in the round transporting unit 130*a*, and this recognition unit 132 recognizes a denomination, an authenticity, a fitness, a face side up/back side up, a version, transportation state, and the like of the banknote transported by the round transporting unit 130*a*.

The round transporting unit 130*a* can transport the banknotes one by one in both the clockwise direction and the counterclockwise direction in FIG. 3. In the transporting unit 130, path switching units (not shown) for switching the banknote transport path between the round transporting unit 130*a* and each connection transporting unit 130*b* are disposed along the round transporting unit 130*a*.

As shown in FIGS. 2 and 3, a banknote receiving opening 120*a* of the banknote receiving unit 120 and a banknote outlet 122*a* of the banknote dispensing unit 122 are provided on the front surface of the housing 101. A door 126*a* is provided on the front side of the cassette mounting unit 126. By opening the door 126*a*, the storage cassette 300 can be mounted on the cassette mounting unit 126 or the storage cassette 300 can be taken out from this cassette mounting unit 126. As shown in FIG. 3, the cassette mounting unit 126 is provided with a mounted cassette detecting unit 127 such as a light sensor for detecting that the storage cassette 300 is mounted on the cassette mounting unit 126. As shown in FIG. 6, the cassette mounting unit 126 is provided with a writer 128 for writing various information in a storage medium 304 (to be described later) provided in the storage cassette 300 mounted on the cassette mounting unit 126, a reader 129 for reading various information from the storage medium 304, respectively. Details of the information written to the storage medium 304 by the writer 128 and the information read from the storage medium 304 by the reader 129 will be described later.

The banknote receiving unit 120 is provided with a banknote feeding mechanism 121. When it is detected that one or more banknotes have been inserted into the banknote receiving opening 120*a*, the banknote feeding mechanism 121 is driven so that the banknotes are fed out one by one to the round transporting unit 130*a* side via the connection transporting unit 130*b*.

The banknote dispensing unit 122 dispenses the banknotes, fed out from each banknote storage unit 134, 136 to the round transporting unit 130*a*, to the outside of the housing 101 via the banknote outlet 122*a*.

The dispense rejecting unit 124 stores the banknote that can not be recognized by the recognition unit 132 due to transportation error such as double feed or skew feed as a dispense reject banknote, of the banknotes fed out from each banknote storage unit 134, 136 at the time of dispense process. Of the banknotes imported into the housing 101 from the banknote receiving unit 120, the banknote that can not be recognized by the recognition unit 132 due to contamination or the like during the deposit process is returned to the banknote dispensing unit 122 as a deposit reject banknote.

Each banknote storage unit 134, 136 stores the banknotes by denomination based on the recognition result by the recognition unit 132. In these banknote storage units 134 and 136, the banknotes to be dispensed from the money depositing/dispensing machine 100 as the change replenishment money to the money change machine 200 are stored. Specifically, for example, a thousand yen banknote is stored in the banknote storage unit 134, and a five thousand yen banknote is stored in the banknote storage unit 136. A 10,000 yen banknote is stored in the collection cassette 140 to be described later. Each banknote storage unit 134, 136 is provided with a banknote feeding mechanism 135, 137. The banknotes stored in these banknote storage units 134, 136 are fed out one by one to the round transporting unit 130*a* side via the connection transporting unit 130*b* by each banknote feeding mechanism 135, 137.

The collection cassette 140 is housed in a lower area inside the housing 101 and the banknotes to be collected by the security company are stored in the collection cassette 140. More specifically, the banknotes recognized by the recognition unit 132 are sent from the round transporting unit 130*a* to the collection cassette 140 via the connection transporting unit 130*b*. A door 140*a* is provided on the front side of the collection cassette 140. By opening the door 140*a*, the collection cassette 140 can be housed inside the housing 101 or the collection cassette 140 can be taken out from the inside of the housing 101.

Next, the configuration of the coin handling device 150 will be described. As shown in FIGS. 2 and 4, the coin handling device 150 includes a coin receiving unit 152 provided in a left side region on the front side of the housing 101, a coin dispensing unit 166 provided below the coin receiving unit 152 on the front side of the housing 101, and a plurality of storage/feeding units 160 for storing the coins inside the housing 101 and capable of feeding out the stored coins.

The coin receiving unit 152 takes the coins received via a coin insertion opening into the housing 101 one by one in a state of one layer and one line. More specifically, the coin receiving unit 152 is provided with a coin feeding mechanism 153 (see FIG. 6) including a feeding belt and the like. When the coins received in the coin receiving unit 152 are detected, the coin feeding mechanism 153 is driven so that the coins are fed out one by one into the housing 101 by the coin feeding mechanism 153. As shown in FIG. 4, to the coin receiving unit 152, a deposited-coin transporting unit 154 for transporting the coins fed out into the housing 101 by the coin receiving unit 152 is connected.

As shown in FIG. 4, in the middle of the deposited-coin transporting unit 154, a recognition unit 156 for recognizing a denomination, an authenticity, a fitness, a face side up/back side up, transportation state, and the like of the coin, and a first diverting unit 158 are provided, respectively. The first diverting unit 158 branches the coin to be paid out from the coin dispensing unit 166, such as a reject coin, from the deposited-coin transporting unit 154 to a coin-to-be-dispensed transporting unit 162 based on the recognition result of the coin by the recognition unit 156.

On the other hand, the coin to be stored in the housing 101 such as a normal coin is transported to each storage/feeding unit 160 by the deposited-coin transporting unit 154. Each storage/feeding unit 160 is configured so as to store the coins by denomination and is able to feed out the stored coins. Specifically, for example, in correspondence with six denominations of the coin distributed in Japan (500 yen coin, 100 yen coin, 50 yen coin, 10 yen coin, 5 yen coin and 1 yen coin), 6 storage/feeding units 160 are provided. The coins are stored in each storage/feeding unit 160 for each denomination such that the coins are stored in an ascending order according to their denominations from upstream side (that is, lower side of FIG. 4) of the deposited-coin transporting unit 154. The storage/feeding unit 160 is provided with a coin feeding mechanism (not shown) for feeding out the coins stored in the storage/feeding unit 160 one by one to the coin-to-be-dispensed transporting unit 162.

The coin-to-be-dispensed transporting unit 162 transports the coins fed out from the storage/feeding unit 160 to the coin dispensing unit 166. In addition, the coin-to-be-dispensed transporting unit 162 transports the reject coin and the like, branched from the deposited-coin transporting unit 154 by the first diverting unit 158, to the coin dispensing unit 166.

The collection cassette 170 is housed in the lower area inside the housing 101, and the coins to be collected by the security company are stored in the collection cassette 170. More specifically, as shown in FIG. 4, a second diverting unit 164 is provided in the middle of the coin-to-be-dispensed transporting unit 162, and the coins branched from the coin-to-be-dispensed transporting unit 162 by the second diverting unit 164 are sent to the collection cassette 170 and stored in this collection cassette 170. A door 170*a* is provided on the front side of the collection cassette 170. By opening the door 170*a*, the collection cassette 170 can be housed inside the housing 101 or the collection cassette 170 can be taken out from the inside of the housing 101.

Next, the configuration of the coin-roll storage device 180 will be described. As shown in FIG. 5, the coin-roll storage device 180 includes a drawer 182 provided with a plurality of storage areas 180*a* to 180*f* in which the coin rolls are stored for each denomination, and the drawer 182 can be withdrawn from the inside of the housing 101 of the money depositing/dispensing machine 100 to the near side. As shown in FIG. 5, when the coin roll is stored in each storage area 180*a* to 180*f*, the longitudinal direction of the coin roll becomes the vertical direction. By drawing the drawer 182 from the inside of the housing 101 of the money depositing/dispensing machine 100 to the near side, it is possible to store the coin rolls in each of the storage areas 180*a* to 180*f* and to take out the coin rolls stored in these storage areas 180*a* to 180*f*. As shown in FIG. 6, the coin-roll storage device 180 is provided with a lock mechanism 184 for locking the drawer 182 inside the housing 101. When the drawer 182 is locked inside the housing 101, the drawer 182 can not be pulled out from the inside of the housing 101 toward the near side. As shown in FIG. 6, the coin-roll storage device 180 is provided with a scale 186 for measuring the weight of the coin rolls stored in each storage area 180*a* to 180*f* of the drawer 182, and a detecting unit 188 for detecting the number of coin rolls taken out from each storage area 180*a* to 180*f* of the drawer 182 based on the weight of the coin rolls measured by the scale 186. Specifically, the detecting unit 188 detects the number of coin rolls taken out from each storage area 180*a* to 180*f* of the drawer 182, based on the difference between the weights of the coin rolls stored in the storage areas 180*a* to 180*f* before and after the coin rolls are taken out from each storage area 180*a* to 180*f* of the drawer 182.

In detecting the number of coin rolls taken out from each storage area 180*a* to 180*f*, instead of measuring the weight of the coin rolls by using the scale 186, or in addition to measuring the weight of the coin rolls by using the scale 186, the number of coin rolls stored in each storage area 180*a* to 180*f* may be detected by using a line sensor or magnetic sensor. Alternatively, by combining these line sensor and magnetic sensor, the number of coin rolls stored in each storage area 180*a* to 180*f* may be detected. Further, the line sensor or magnetic sensor may be provided for each storage area 180*a* to 180*f*.

Next, the configuration of the control system in such a money depositing/dispensing machine 100 will be described with reference to FIG. 6. As shown in FIG. 6, in the housing 101 of the money depositing/dispensing machine 100 according to the present embodiment, a controlling unit 102 is provided, and the controlling unit 102 controls each component of each of the banknote handling device 110, coin handling device 150 and coin-roll storage device 180. Specifically, to the controlling unit 102, the banknote feeding mechanism 121, transporting unit 130, recognition unit 132, banknote feeding mechanisms 135, 137, cassette mounting unit 126, mounted cassette detecting unit 127, writer 128, reader 129 and the like of the banknote handling device 110 are connected. The recognition information of the banknote by the recognition unit 132, detection information of the storage cassette 300 by the mounted cassette detecting unit 127, information read from the storage medium 304 provided in the storage cassette 300 by the reader 129 and the like are sent to the controlling unit 102. The controlling unit 102 sends a command signal to each component of the banknote handling device 110 to control these components. In addition, to the controlling unit 102, the coin feeding mechanism 153, deposited-coin transporting unit 154, recognition unit 156, first diverting unit 158, each storage/feeding unit 160, coin-to-be-dispensed transporting unit 162, second diverting unit 164 and the like of the coin handling device 150 are connected. The recognition information of the coin by the recognition unit 156 is sent to the controlling unit 102. The controlling unit 102 sends a command signal to each component of the coin handling device 150 to control these components. Further, to the controlling unit 102, the lock mechanism 184, scale 186, detecting unit 188 and the like of the coin-roll storage device 180 are connected. The measurement result of the coin rolls by the scale 186 and the detection result of the detecting unit 188 (specifically, the number of coin rolls taken out from the storage areas 180*a* to 180*f* of the drawer 182) are sent to the controlling unit 102. The controlling unit 102 controls the lock mechanism 184 by sending a command signal to the lock mechanism 184.

As shown in FIG. 6, to the controlling unit 102, a printing unit 103, an operation/display unit 104, a communicating unit 105, a memory unit 106, an authentication unit 107, a receiving unit 108, and a first judging unit 109 are connected. The printing unit 103 is composed of a printer and the like provided on the upper part of the housing 101. The printing unit 103 prints various kinds of information such as information on the amount of the money stored in each of the banknote handling device 110, the coin handling device 150 and the coin-roll storage device 180 and process history of the money in money depositing/dispensing machine 100 and the like on the receipt. The operation/display unit 104 is composed of a touch panel or the like provided on the upper part of the housing 101. An operation screen for the operator to operate and the information on the amount of the money stored in each of the banknote handling device 110, the coin handling device 150 and the coin-roll storage device 180 are displayed on the operation/display unit 104. In such an operation/display unit 104, the operator can input various commands to the controlling unit 102 by touching the operation button on the operation screen with his/her finger. The communicating unit 105 can transmit and receive various signals to and from each POS register 290 via the LAN 16.

In the memory unit 106, various kinds of information such as the information on the amount of the money stored in each of the banknote handling device 110, coin handling device 150 and the coin-roll storage device 180, the process history of the money in the money depositing/dispensing machine 100 and the like are stored. The authentication unit 107 authenticates an identification information, an authority and the like of the operator who operates the money depositing/dispensing machine 100. Specifically, for example, in the case where the operator inputs his/her identification number and password by the operation/display unit 104, the authentication unit 107 authenticates the operator's identification information, authority, and the like, based on the operator's identification number and password input by the operation/display unit 104. As another example, as the authentication unit 107, a card reader for reading an ID card and the like possessed by the operator may be provided in the money depositing/dispensing machine 100. In this case, the authentication unit 107 authenticates the operator's identification information, authority, and the like, based on the information read from the ID card and the like by the card reader. As will be described later, in this embodiment, only when the authority of the operator authenticated by the authentication unit 107 is a predetermined authority (specifically, the manager 30), the controlling unit 102 causes the lock mechanism 184 to unlock the drawer 182. Thus, only an operator having the predetermined authority (more specifically, the manager 30) can draw the drawer 182 from the inside of the housing 101 of the money depositing/dispensing machine 100 to the near side and take out the coin rolls from each storage area 180*a* to 180*f* of the drawer 182.

The receiving unit 108 receives information on the money (specifically, the banknotes and coin rolls) to be replenished as the change replenishment money to the money change machine 200 installed in each of the plurality of settlement places 20. When the operator inputs information on the money to be replenished as the change replenishment money to the money change machine 200 of each of the plurality of settlement places 20 by the operation/display unit 104, the receiving unit 108 receives the information on the money to be replenished as the change replenishment money to the money change machine 200 of each of the plurality of settlement places 20 based on the information input by the operation/display unit 104. Alternatively, the receiving unit 108 may receive the information on the money to replenish the money change machine 200 installed in each of the plurality of settlement places 20 based on the information read from the storage medium 304 (to be described later) attached to the storage cassette 300 mounted on the cassette mounting unit 126. Specifically, the storage medium 304 (to be described later) of the storage cassette 300 stores the information on the money to replenish the money change machine 200 as the change fund. When it is detected by the mounted cassette detecting unit 127 that the storage cassette 300 is mounted on the cassette mounting unit 126, the information stored in the storage medium 304 is read by the reader 129 provided in the cassette mounting unit 126. Then, based on the information read from the storage medium 304 of each of the plurality of storage cassettes 300, the receiving unit 108 receives the information on the money to replenish the money change machine 200 installed in each of the plurality of settlement places 20. As still another example, the receiving unit 108 may receive the information on the money to be replenished as the change replenishment money to the money change machine 200 of each of the plurality of settlement places 20, based on the information sent from the external device (for example, the POS register 290 installed in each of the plurality of settlement places 20) to the controlling unit 102 via the communicating unit 105. Information on the money to be replenished as the change replenishment money to the money change machine 200 of each of the plurality of settlement places 20 received by the receiving unit 108 is stored in the memory unit 106. Details of the function of such receiving unit 108 will be described later.

In the present embodiment, the controlling unit 102 calculates the total number of coin rolls to replenish the money change machine 200 installed in each of the plurality of settlement places 20 based on the information received by the receiving unit 108. In addition, the controlling unit 102 outputs the calculated total number of coin rolls. The first judging unit 109 judges whether the number of coin rolls taken out from each storage area 180*a* to 180*f* of the drawer 182 based on the detection result by the detecting unit 188 of the coin-roll storage device 180 coincides with the total number of coin rolls to replenish the money change machine 200 installed in each of the plurality of settlement places 20 calculated by the controlling unit 102. If it is judged by the first judging unit 109 that the number of coin rolls taken out from each storage area 180*a* to 180*f* of the drawer 182 does not coincide with the total number of coin rolls to replenish the money change machine 200 installed in each of the plurality of settlement places 20 calculated by the controlling unit 102, the controlling unit 102 outputs a warning information. Specifically, the warning information output by the controlling unit 102 is displayed as a warning message on the operation/display unit 104. Details of the function of such first judging unit 109 will be described later.

Next, the details of the configurations of the money change machine 200 and the POS register 290 provided in each of the plurality of settlement places 20 in the front area 12 of the store will be briefly described with reference to FIG. 7. As shown in FIG. 7, the money change machine 200 according to the present embodiment includes a coin handling device 250 and a coin-roll storage device 280 arranged to line up and down, and a banknote handling device 210 arranged to be next to the coin handling device 250 and the coin-roll storage device 280. In addition, the POS register 290 is placed above the banknote handling device 210 and the coin handling device 250. The banknote handling device 210 and the coin handling device 250 perform deposit/dispense process of the banknotes in a separate state and the coins in a separate state, respectively. The coin-roll storage device 280 stores the coin rolls of each denomination in a removable manner. An operation/display unit 270 such as a touch panel is provided on the front side of the upper surface of the coin handling device 250. In the operation/display unit 270, an operation screen for the operator to operate and the information on the amount of money stored in each of the banknote handling device 210, the coin handling device 250 and the coin-roll storage device 280 are displayed. Furthermore, in such an operation/display unit 270, the operator can input various commands to the controlling unit (not shown) of the money change machine 200 by touching the operation button on the operation screen with his/her finger. The POS register 290 is used as a management apparatus for managing the money change machine 200.

As shown in FIG. 7, a second judging unit 260 is provided in the money change machine 200. The second judging unit 260 judges whether the total number of coin rolls to replenish each money change machine 200 installed in the plurality of settlement places coincides with the number of coin rolls dispensed from the money depositing/dispensing machine 100. Details of the function of such a second judging unit 260 will be described later.

Next, the configuration of the storage cassette 300 for delivering the banknotes between the money depositing/dispensing machine 100 and each money change machine 200 will be described with reference to FIG. 8. As shown in FIG. 8, the storage cassette 300 has a substantially parallelepiped casing 301, and the banknotes are accommodated in the casing 301 in a stacked state. As described above, the storage cassette 300 is detachably mounted on the cassette mounting unit 126 of the money depositing/dispensing machine 100 and a cassette mounting unit (not shown) of the money change machine 200, respectively. An opening 302 is formed on the side surface of the casing 301 of the storage cassette 300. When the storage cassette 300 is mounted on the cassette mounting unit 126 of the money depositing/dispensing machine 100 or the cassette mounting unit of the money change machine 200, the banknotes are sent to the inside of the storage cassette 300 from the transporting unit 130 provided in the banknote handling device 110 of the money depositing/dispensing machine 100 or a transporting unit (not shown) provided in the banknote handling device 210 of the money change machine 200 via the opening 302. In addition, the banknotes stored in the storage cassette 300 are fed out to the transporting unit 130 of the banknote handling device 110 of the money depositing/dispensing machine 100 or the transporting unit of the banknote handling device 210 of the money change machine 200 via the opening 302.

More specifically, inside the storage cassette 300, there is provided a banknote feeding mechanism for feeding out the banknotes stored in the storage cassette 300 to the outside of the casing 301 via the opening 302. When the storage cassette 300 is mounted on the cassette mounting unit 126 of the money depositing/dispensing machine 100 or the cassette mounting unit (not shown) of the money change machine 200, power is transmitted from the banknote handling device 110 of the money depositing/dispensing machine 100 or the banknote handling device 210 of the money change machine 200 to the banknote feeding mechanism of the storage cassette 300. In this way, in a state in which the storage cassette 300 is taken out from the cassette mounting unit 126 of the money depositing/dispensing machine 100 or the cassette mounting unit of the money change machine 200, the banknotes stored in the storage cassette 300 can not be fed out to the outside of the casing 301. This makes it possible to improve security of the banknotes stored in the storage cassette 300.

On the side surface of the casing 301 of the storage cassette 300, the storage medium 304 such as an IC chip is provided. When the storage cassette 300 is mounted on the cassette mounting unit 126 of the money depositing/dispensing machine 100 or the cassette mounting unit (not shown) of the money change machine 200, various information is written to the storage medium 304 by the writer 128 provided in the cassette mounting unit 126 of the money depositing/dispensing machine 100 or a writer (not shown) provided in the cassette mounting unit of the money change machine 200. In addition, various information is read from the storage medium 304 by the reader 129 provided in the cassette mounting unit 126 of the money depositing/dispensing machine 100 or a reader (not shown) provided in the cassette mounting unit of the money change machine 200.

Further, in the money handling system 10 of the present embodiment, apart from the storage cassette 300, in order to deriver the money other than the banknotes (specifically, the coins in a separate state and coin rolls) between the money depositing/dispensing machine 100 and each money change machine 200, a storage case 400 (see FIG. 1) in which the coins in a separate state and coin rolls are stored is used. Specifically, when replenishing the money as the change replenishment money to the money change machine 200 provided in each of the plurality of settlement places 20, the cashier corresponding to each of the plurality of settlement places 20 carries the storage cassette 300 storing the banknotes as the change replenishment money and the storage case 400 storing the coin rolls as the change fund from the back office area 14 to the front area 12. On the other hand, when collecting the money as the sales proceeds from the money change machine 200 provided in each of the plurality of settlement places 20, the cashier corresponding to each of the plurality of settlement places 20 carries the storage cassette 300 storing the banknotes as the sales proceeds and the storage case 400 storing the coins in a separate state as the sales proceeds from the front area 12 to the back office area 14.

Next, the operation of the money handling system 10 having such a configuration will be described. Specifically, the operation of depositing the money as the sales proceeds collected from the money change machine 200 installed in each of the plurality of settlement places 20 of the front area 12 to the money depositing/dispensing machine 100 installed in the back office area 14, and the operation of replenishing the money as the change replenishment money dispensed from the money depositing/dispensing machine 100 installed in the back office area 14 to the money change machine 200 installed in each of the plurality of settlement places 20 of the front area 12 will be described.

First, the operation of depositing the money as the sales proceeds collected from the money change machine 200 installed in each of the plurality of settlement places 20 of the front area 12 to the money depositing/dispensing machine 100 installed in the back office area 14 will be described. When the opening hour of the store is over, the cashier who was doing the checkout of the merchandises in the settlement place 20 of the front area 12 collects the banknotes and coins as the sales proceeds from the money change machine 200. Specifically, the cashier mounts the empty storage cassette 300 on the cassette mounting unit of the banknote handling device 210, so that the banknotes as the sales proceeds stored in the banknote handling device 210 are stored in the storage cassette 300. When the banknotes are stored in the storage cassette 300 mounted on the cassette mounting unit in the banknote handling device 210, the information of the banknotes that have been stored in the storage cassette 300 (specifically, the number of banknotes for each denomination) and the like is written in the storage medium 304 of the storage cassette 300 by the reader/writer provided in the banknote handling device 210. In addition, the information on the money (specifically, the banknotes and coin rolls) to be deposited into money change machine 200 on the next day as the change fund (specifically, the number of banknotes and coin rolls for each denomination) is written in the storage medium 304 of the storage cassette 300. Information such as the identification number of the settlement place 20 where the money change machine 200 is installed, the identification number of the cashier and the like may be written in the storage medium 304 of the storage cassette 300. In addition, the cashier dispenses the coins as the sales proceeds from the coin handling device 250, and the dispensed coins are stored by hand in the storage case 400. Further, the cashier removes a medium other than the money (for example, a gift certificate and the like) stored in the coin-roll storage device 280 by hand, and the retrieved medium is stored in the storage case 400 by hand. When the cashier collects the money and the like from the money change machine 200, the information on the collected money and the like is printed on the receipt by a printing unit such as a printer. The receipt on which such information is printed is also called a journal. The cashier also stores the receipt printed by the printing unit such as a printer in the storage case 400 by hand.

The cashier who collects the banknotes, coins and the like as the sales proceeds from the money change machine 200 installed in the settlement place 20 in the front area 12 carries the storage cassette 300 and storage case 400 collectively from the settlement place 20 of the front area 12 to the back office area 14. Then, the cashier deposits the banknotes and coins as the sales proceeds to the money depositing/dispensing machine 100. Specifically, the cashier mounts the storage cassette 300 on the cassette mounting unit 126 in the banknote handling device 110 of the money depositing/dispensing machine 100. As a result, the banknotes as the sales proceeds stored in the storage cassette 300 are stored in the banknote handling device 110. Then, the information stored in the storage medium 304 of the storage cassette 300 is read by the reader 129. As a result, the banknote information (more specifically, the number of banknotes for each denomination) as the sales proceeds stored in the storage cassette 300 is managed by the controlling unit 102 of the money depositing/dispensing machine 100. In addition, the cashier takes out the coins from the storage case 400, and puts the taken coins into the coin receiving unit 152 of the coin handling device 150 of the money depositing/dispensing machine 100. As a result, the coins as the sales proceeds are deposited in the money depositing/dispensing machine 100.

Next, the operation of replenishing the money as the change replenishment money dispensed from the money depositing/dispensing machine 100 installed in the back office area 14 to the money change machine 200 installed in each of the plurality of settlement places 20 of the front area 12 will be described. First, the cashier of each of the plurality of settlement places 20 stores the banknotes as the change replenishment money from the money change machine 200 to the storage cassette 300. Specifically, the cashier first causes the authentication unit 107 to authenticate the operator's authority. When the authentication unit 107 authenticates that the operator's authority is the cashier, the cashier mounts the empty storage cassette 300 on the cassette mounting unit 126 in the banknote handling device 110 of the money depositing/dispensing machine 100. As a result, the banknotes stored in each banknote storage unit 134, 136 of the banknote handling device 110 are sent to the storage cassette 300. At this time, the information on the money as the change replenishment money dispensed from the money depositing/dispensing machine 100 (more specifically, the number of banknotes for each denomination and the number of coin rolls for each denomination to be described later) is written in the storage medium 304 of the storage cassette 300 by the writer 128.

Further, the manager 30, who is a different operator from the cashier, takes out the coin rolls as the change replenishment money from the coin-roll storage device 180 of the money depositing/dispensing machine 100. Specifically, the manager 30 firstly authenticates the operator's authority through the authentication unit 107. Then, when the authentication unit 107 authenticates that the operator's authority is the manager, the lock mechanism 184 unlocks the drawer 182. Thus, only the manager 30 can draw the drawer 182 from the inside of the housing 101 of the money depositing/dispensing machine 100 to the near side, so that the coin rolls can be taken out from each storage area 180*a* to 180*f* of the drawer 182. When depositing the money as the change replenishment money to each of money change machines 200 installed in the plurality of corresponding settlement places 20, the manager 30 takes out the coin rolls to replenish each of the money change machines 200 installed in corresponding settlement place 20 from the coin-roll storage device 180 at a time. After that, the manager 30 sorts the coin rolls taken out from the coin-roll storage device 180 for each of the plurality of settlement places 20, and stores the sorted coin rolls in the plurality of the storage cases 400 corresponding to each of the plurality of settlement places 20. Then, the manager 30 hands the storage case 400 storing the coin rolls as the change fund to the cashier of each of the plurality of settlement places 20.

In the present embodiment, when the manager 30 takes out the coin rolls as the change replenishment money from the coin-roll storage device 180 of the money depositing/dispensing machine 100, the information on the coin rolls to replenish the money change machine 200 of each of the plurality of settlement places 20 is received by the receiving unit 108. The controlling unit 102 calculates the total number of coin rolls to replenish each of the plurality of settlement places 20 based on the information received by the receiving unit 108. Specifically, when the manager 30 takes out the coin rolls as the change replenishment money from the coin-roll storage device 180 of the money depositing/dispensing machine 100, after having authorized the operator's authority by the authentication unit 107, the manager 30 inputs the number of coin rolls for each denomination to replenish the money change machine 200 of each of the plurality of settlement places 20 by the operation/display unit 104 for each of the plurality of settlement places 20. As a result, the receiving unit 108 receives the information on the coin rolls to replenish the money change machine 200 of each of the plurality of settlement places 20 based on the information input by the operation/display unit 104 by the manager 30. As another method, when the collection process of the money described above is performed, in the case where the information relating to the coin rolls to replenish the money change machine 200 as the change fund is stored in the storage medium 304 of the storage cassette 300, when it is detected by the mounted cassette detecting unit 127 that the storage cassette 300 is mounted on the cassette mounting unit 126, the information stored in the storage medium 304 is read by the reader 129 provided in the cassette mounting unit 126. Then, the receiving unit 108 receives the information on the coin rolls to replenish the money change machine 200 installed in each of the plurality of settlement places 20, based on the information read from the storage medium 304 of each of the plurality of storage cassettes 300. As still another example, the information on the coin rolls to be replenished as the change replenishment money to the money change machine 200 of each of the plurality of settlement places 20 may be transmitted from the external device (for example, the POS register 290 installed in each of the plurality of settlement places 20) to the controlling unit 102 via the communicating unit 105. In this case, the receiving unit 108 receives the information on the coin rolls to be replenished as the change replenishment money to the money change machine 200 of each of the plurality of settlement places 20, based on the information sent from the external device such as the POS register 290 to the controlling unit 102 via the communicating unit 105.

In the present embodiment, the controlling unit 102 calculates the total number of coin rolls to replenish the money change machine 200 of each of the plurality of settlement places 20 based on the information received by the receiving unit 108, and outputs the calculated total number of coin rolls. Specifically, the total number of coin rolls calculated by the controlling unit 102 is displayed on the operation/display unit 104. As a result, the operator takes out the coin rolls from each storage area 180*a* to 180*f* of the drawer 182 by the total number of coin rolls calculated by the controlling unit 102 displayed on the operation/display unit 104.

When the coin rolls are taken out from each storage area 180*a* to 180*f* of the drawer 182 in the coin-roll storage device 180 by the manager 30 and the drawer 182 is returned inside the housing 101, the number of coin rolls dispensed from the coin-roll storage device 180 is detected by the detecting unit 188. Then, the controlling unit 102 outputs the information about the coin rolls dispensed from the coin-roll storage device 180 based on the detection result by the detecting unit 188. Specifically, the controlling unit 102 outputs the information about the coin rolls dispensed from the coin-roll storage device 180 for each of the plurality of settlement places 20 (more specifically, for each money change machine 200) based on the detection result by the detecting unit 188. The information about the coin rolls dispensed from the coin-roll storage device 180 output by the controlling unit 102 is printed on the receipt by the printing unit 103. Specifically, the printing unit 103 prints the number of coin rolls as the change replenishment money for each of the plurality of settlement places 20 and the total number of coin rolls dispensed from coin-roll storage device 180, on a single receipt. Accordingly, while watching the receipt printed by the printing unit 103, the manager 30 can sort the coin rolls taken out from the coin-roll storage device 180 for each of the plurality of settlement places 20 and store them in each storage case 400.

In the present embodiment, after the coin rolls are taken out from each storage area 180*a* to 180*f* of the drawer 182 in the coin-roll storage device 180 by the manager 30, and when the drawer 182 is returned to inside the housing 101, the first judging unit 109 judges whether the number of coin rolls taken out from the coin-roll storage device 180 based on the detection result by the detecting unit 188 coincides with the total number of coin rolls to replenish the money change machine 200 installed in each of the plurality of settlement places 20 calculated by the controlling unit 102. If it is judged by the first judging unit 109 that the number of coin rolls taken out from the coin-roll storage device 180 based on the detection result by the detecting unit 188 does not coincide with the total number of coin rolls to replenish the money change machine 200 installed in each of the plurality of settlement places 20 calculated by the controlling unit 102, the controlling unit 102 outputs the warning information. The warning information output by the controlling unit 102 is displayed as a warning message on the operation/display unit 104 and/or is transmitted to the host terminal and the like by the communicating unit 105. This makes it possible to notify the manager 30 that there is an error in the number of coin rolls taken out from the coin-roll storage device 180.

As described above, the manager 30 sorts the coin rolls taken out from the coin-roll storage device 180 for each of the plurality of settlement places 20 and stores the sorted coin rolls in the plurality of the storage cases 400 corresponding to each of the plurality of settlement places 20. Then, the manager 30 hands the storage case 400 storing the coin rolls as the change fund to the cashier of each of the plurality of settlement places 20. After that, the cashier derivers the storage cassette 300 storing the banknotes dispensed from banknote handling device 110 of money depositing/dispensing machine 100 and the storage case 400 handed out from and the manager 30, collectively from the back office area 14 to the settlement place 20 of the front area 12. Then, the cashier deposits the banknotes or coin rolls as the change fund to the money change machine 200. Specifically, the cashier mounts the storage cassette 300 on the cassette mounting unit in the banknote handling device 210 of the money change machine 200. As a result, the banknotes as the change fund stored in the storage cassette 300 are stored in the banknote handling device 210. In addition, the information stored in the storage medium 304 of the storage cassette 300 is read by the reader. As a result, the information on the money (specifically, the banknotes and coin rolls) as the change replenishment money for each of the plurality of settlement places 20 (specifically, for each money change machine 200) dispensed from the money depositing/dispensing machine 100 is managed by the controlling unit of money change machine 200. In addition, the cashier takes out the coin rolls from the storage case 400 and stores the taken coin rolls in the coin-roll storage device 280 of the money change machine 200, or breaks the wrapping paper of the coin rolls to make the coins in a separate state, and then deposits these coins into the coin handling device 250. In this way, the money change machine 200 is replenished with the coin rolls or the coins in a separate state as the change fund.

In the present embodiment, when the coin rolls are replenished to the money change machines 200 of the plurality of settlement places 20 by the cashier of each of the plurality of settlement places 20, it is judged by the second judging unit 260 provided in a certain money change machine 200 whether the total number of coin rolls to replenish each money change machine 200 coincides with the number of coin rolls dispensed from the money depositing/dispensing machine 100. If the second judging unit 260 determines that the total number of coin rolls to replenish each money change machine 200 does not coincide with the number of coin rolls dispensed from the money depositing/dispensing machine 100, the warning information is output by the controlling unit (not shown) of the money change machine 200. Then, the output warning information is displayed as a warning message in the operation/display unit 270 (see FIG. 7) of the money change machine 200, the display unit of the POS register 290, the operation/display unit 104 of the money depositing/dispensing machine 100, and the like. This makes it possible to notify the manager 30 and/or each cashier that the coin rolls dispensed from the money depositing/dispensing machine 100 are not all replenished to the money change machine 200 of each of the plurality of settlement places 20 yet.

According to the money handling system 10 of the present embodiment having the above configuration and the money depositing/dispensing machine 100 provided in such money handling system 10, the authority of the operator is authenticated by the authentication unit 107, and only when the authority of the operator authenticated by the authentication unit 107 is the predetermined authority (specifically, the manager), the coin-roll storage device 180 is controlled so as to dispense the coin rolls to replenish the plurality of settlement places 20 (specifically, the money change machines 200 as the settlement apparatus installed in each of the plurality of settlement places 20) at a time. In this manner, since only when the authority of the operator authenticated by the authentication unit 107 is the predetermined authority, it is possible to dispense the coin rolls to replenish the plurality of settlement places 20 at a time, only those with the predetermined authority such as the manager can dispense the coin rolls and sort the dispensed coin rolls for each of the plurality of settlement places 20. Therefore, compared with the case where the cashier of settlement place 20 dispenses the coin rolls, security can be improved. More specifically, in the traditional money handling system, when replenishing the coin rolls as the change fund to the money change machines provided in each of the plurality of settlement places, the cashier of the settlement place dispensed the coin rolls from the money depositing/dispensing machine, put the dispensed coin rolls in the storage case by hand, and then delivered the storage case to the settlement place. However, in this case, there was a problem in terms of security, because the cashier carries the coin rolls from the back office area to the settlement place of the front area by putting them in the storage case and the like with the hand of cashier. Also, since the cashier can draw the drawer from the housing of the money depositing/dispensing machine and take out the coin rolls stored in each drawer's storage area, there was a risk that a large amount of the coin rolls would be taken out from the money depositing/dispensing machine. On the other hand, in the present embodiment, since only a person having the predetermined authority such as the manager can dispense the coin rolls from the money depositing/dispensing machine 100, security can be improved.

Also, in the money depositing/dispensing machine 100, the coin-roll storage device 180 includes a storage portion in which the coin rolls are stored (specifically, the drawer 182 provided with the storage areas 180*a* to 180*f* for storing the coin rolls) and the lock mechanism 184 for locking the drawer 182 as the storage portion in the housing 101. Only when the authority of the operator authenticated by the authentication unit 107 is the predetermined authority (specifically, the manager), the controlling unit 102 releases the locking of the storage portion by the lock mechanism 184. In this case, only the operator having the predetermined authority can draw out the drawer 182 as the storage portion from the housing 101 and take out the coin rolls from the drawer 182.

In the present embodiment, the coin-roll storage unit for storing the coin rolls is not limited to the coin-roll storage device 180 having such a configuration that the drawer 182 provided with each storage area 180*a* to 180*f* for storing the coin rolls can be pulled out from the housing 101. As the coin-roll storage unit for storing the coin rolls, a configuration in which the coin rolls are automatically discharged from the inside of the housing to the outside may be used. Specifically, such a coin roll storage unit includes a plurality of storage/feeding portions which can store the coin rolls for each denomination and can feed out the stored coin rolls one by one, a dispensing outlet for dispensing the coin rolls from the inside to the outside and a transporting portion for transporting the coin rolls fed out from each storage/feeding unit to the dispensing outlet. When a coin roll dispense order is input by the operator having the predetermined authority, the coin rolls to be dispensed are fed out from each storage/feeding portion to the transporting portion, and transported to the dispensing outlet by the transporting portion. In this way, the operator having the predetermined authority can take out the coin rolls from the dispensing outlet to the outside of the housing. The principle of the present invention can also be applied to the coin roll storage unit having such a configuration. That is, only when the authority of the operator authenticated by the authentication unit is the predetermined authority, each storage/feeding portion and the transporting portion are controlled so as to dispense the coin rolls to replenish the plurality of settlement places at a time.

It should be noted that the money handling system according to the present invention is not limited to the above-described aspect, and various modifications can be made.

For example, instead of installing the money change machine 200 as the settlement apparatus in each of the plurality of settlement places 20, a cash drawer, a coin-roll storage, or the like in which the coin rolls can be stored may be installed. Also in this case, the coin rolls dispensed from the money depositing/dispensing machine 100 are stored as the change replenishment money in the settlement apparatus such as the cash drawer, the coin-roll storage, or the like in each of the plurality of settlement places 20. As the settlement apparatus installed in each of the plurality of settlement places 20, one that can not detect the number of coin rolls replenished to the settlement apparatus may be used.

The money depositing/dispensing machine 100 of the above configuration may be installed in the settlement place 20 of the front area 12 instead of being installed in the back office area 14 of the store. In this case, in the front area 12, the money depositing/dispensing machine 100 is connected to the POS register 290, and the money depositing/dispensing machine 100 functions as a money change machine. Furthermore, the money depositing/dispensing machine 100 installed in the front area 12 functions as a deposit machine for depositing the money as the sales proceeds or surplus collected from money change machine 200, functions as a dispense machine for dispensing the money to replenish the money change machine 200 (i.e., the change replenishment money), or functions as a money change machine that exchanges the money with the money of the same amount and different denomination as the money paid out from the money change machine 200.

Furthermore, the money change machine 200 installed as the settlement apparatus in each of a plurality of settlement places 20 may be used as a self-register or semi-self-register. The self-register is a register in which the customer performs the operation of inputting the information of the merchandises to be purchased into the POS register 290 and the operation of depositing the money for the merchandises to the money change machine 200. The semi-self-register is a register in which the cashier performs the operation of inputting the information of the merchandises that the customer intends to purchase into the POS register 290, and the customer performs the operation of depositing the money for the merchandises to the money change machine 200. In this way, even when the money change machine 200 installed as the settlement apparatus in each of a plurality of settlement place 20 is used as the self-register or semi-self-register, the principle of the present invention can be applied.

Further, in the above description, the aspect in which the authentication unit 107 for authenticating the operator's authority is provided in the money depositing/dispensing machine 100 has been described. However, the money handling system according to the present invention is not limited to such an aspect. As a money handling system according to a modified example, the authentication unit for authenticating the operator's authority may be provided in an apparatus other than the money depositing/dispensing machine 100 (for example, the money change machine 200, POS register 290, higher-ranking machine of the money depositing/dispensing machine 100, and the like). In this case, only when the authority of the operator authenticated by the authentication unit installed in these apparatuses is the predetermined authority, the coin rolls to replenish the money change machine 200 installed in the plurality of settlement place 20 are dispensed from the coin-roll storage device 180 of the money depositing/dispensing machine 100 at a time.

Further, in the above description, an aspect in which the first judging unit 109 that judges whether the number of coin rolls taken out from each storage area 180*a* to 180*f* of the drawer 182 in the coin-roll storage device 180 coincides with the total number of coin rolls to replenish the money change machine 200 installed in each of the plurality of settlement places 20 calculated by the controlling unit 102 is provided in the money depositing/dispensing machine 100 has been described. However, the money handling system according to the present invention is not limited to such an aspect. As another money handling system according to a modified example, the first judging unit that performs the above-described determination may be provided in an apparatus other than the money depositing/dispensing machine 100 (for example, the money change machine 200, POS register 290, or higher-ranking machine of the money depositing/dispensing machine 100). In addition, in the above description, an aspect in which the second judging unit 260 that judges whether the total number of coin rolls to replenish each money change machine 200 installed in the plurality of settlement places 20 coincides with the number of coin rolls dispensed from the money depositing/dispensing machine 100 is provided in the money change machine 200 has been described. However, the money handling system according to the present invention is not limited to such an aspect. As a still other money handling system according to another modified example, the second judging unit that performs the above-described determination may be provided in an apparatus other than the money change machine 200 (for example, the money depositing/dispensing machine 100, POS register 290, and the like).

In addition, when stocktaking is performed at the store where the money handling system 10 according to the present embodiment is installed, the coin rolls may be taken out from the coin-roll storage device 280 of the money change machine 200 installed in each of the plurality of settlement places 20, and the taken coin rolls may be stored in the coin-roll storage device 180 of the money depositing/dispensing machine 100. In this case, only when the authority of the operator authenticated by the authentication unit 107 is the predetermined authority (for example, the manager), the coin-roll storage device 180 is controlled by the controlling unit 102 so that the coin rolls taken out from the money change machine 200 of the plurality of settlement place 20 are deposited at a time. Specifically, the coin rolls taken out from the coin-roll storage device 280 of the money change machine 200 installed in each of the plurality of settlement places 20 are entrust to the manager 30. Then, when the manager 30 authenticates the authority of the operator with the authentication unit 107, the lock mechanism 184 unlocks the drawer 182 and the manager 30 can draw the drawer 182 from the housing 101. In this way, the manager 30 can store the coin rolls taken out from the money change machine 200 of the plurality of settlement place 20 in each storage area 180*a* to 180*f* of the drawer 182 at a time.

What is claimed is:

1. A money handling machine comprising:

a coin-roll storage unit configured to store a coin roll;

a loose-banknote storage unit configured to store banknotes in a separate state;

an authentication unit configured to authenticate an operator as part of a first group having a first predetermined authority providing access to dispensing of the banknotes stored in the loose banknote storage unit or as part of a second group, different than the first group, having a second predetermined authority providing access to the dispensing of the coin roll stored in the coin-roll storage unit, when a dispensing process of the money that is to be replenished from the money handling machine to a plurality of settlement places is performed, and wherein the second predetermined authority is different from the first predetermined authority and provides access to the coin rolls of the storage unit; and a controlling unit configured to calculate a total number of coin rolls and loose banknotes required to replenish each of the plurality of settlement places based on at least one electrical communication received by the money handling machine from the plurality of settlement places remotely located thereto, the controlling unit further configured to control the coin-roll storage unit so as to dispense the number of coin rolls to replenish each of the plurality of settlement places at a time only when the operator is authenticated by the authentication unit as part of the second group having the second predetermined authority and to dispense the number of banknotes at a time when the operator is authenticated by the authentication unit as part of the first group having the first predetermined authority.

2. The money handling machine according to claim 1, wherein the coin-roll storage unit includes a storage portion in which the coin roll is stored and a lock mechanism configured to lock the storage portion inside a casing, and the controlling unit controls the lock mechanism so as to release the lock of the storage portion only when the authority of the operator authenticated by the authentication unit is the second predetermined authority.

3. The money handling machine according to claim 1, further comprising a receiving unit configured to receive information on the coin roll to replenish each of the plurality of settlement places, and the controlling unit calculates a total number of the coin roll to replenish each of the plurality of settlement places based on the information received by the receiving unit.

4. The money handling machine according to claim 3, further comprising a cassette mounting unit on which at least one of a plurality of storage cassettes is detachably mounted, each of the plurality of storage cassettes stores money in a separate state and feeds out the money to be stored, each of the plurality of storage cassettes corresponds to each of the plurality of settlement places, each of the plurality of storage cassettes is provided with a storage medium for storing the information on the coin roll to replenish the corresponding settlement place, and the receiving unit receives the information on the coin roll to replenish each of the plurality of settlement places based on the information read from the storage medium of each of the plurality of storage cassettes.

5. The money handling machine according to claim 3, wherein the controlling unit outputs the total number of the coin roll.

6. The money handling machine according to claim 3, further comprising:

a detecting unit configured to detect the number of coin rolls dispensed from the coin-roll storage unit; and a first judging unit configured to judge whether the number of coin rolls dispensed from the coin-roll storage unit based on a detection result by the detecting unit coincides with the total number of the coin roll to replenish each of the plurality of settlement places calculated by the controlling unit.

7. The money handling machine according to claim 6, wherein the controlling unit outputs a warning information when it is judged by the first judging unit that the number of coin rolls dispensed from the coin-roll storage unit based on the detection result by the detecting unit does not coincide with the total number of the coin roll to replenish each of the plurality of settlement places calculated by the controlling unit.

8. The money handling machine according to claim 1, further comprising a detecting unit configured to detect the number of coin rolls dispensed from the coin-roll storage unit, and the controlling unit outputs information about the coin roll dispensed from the coin-roll storage unit based on detection result by the detecting unit.

9. The money handling machine according to claim 8, wherein the controlling unit outputs the information about the coin roll dispensed from the coin-roll storage unit for each of the plurality of settlement places.

10. The money handling machine according to claim 8, further comprising a printing unit configured to print the information output by the controlling unit about the coin roll dispensed from the coin-roll storage unit.

11. The money handling machine according to claim 1, further comprising a cassette mounting unit on which at least one of a plurality of storage cassettes is detachably mounted, each of the plurality of storage cassettes stores banknotes in a separate state and feeds out the stored banknotes, each of the plurality of storage cassettes corresponds to each of the plurality of settlement places, the loose-banknote storage unit is capable of feeding out the banknotes stored in the loose-banknote storage unit, and the control unit controls the loose-banknote storage unit so as to dispense the m banknotes stored in the loose-banknote storage unit and store the dispensed banknotes in the storage cassette mounted on the cassette mounting unit when the authority of the operator authenticated by the authentication unit is the first predetermined authority.

12. A money handling system comprising:

a money handling machine that includes a coin-roll storage unit configured to store coin rolls and a loose-banknote storage unit configured to store banknotes in a separate state, an authentication unit configured to authenticate an operator, and a controlling unit configured to calculate a total number of coin rolls required to replenish each of a plurality of settlement places based on an electrical communication received by the money handling machine remotely located from a plurality of settlement places, the controlling unit further configured to control the loose banknote storage unit to dispense the banknotes when the operator has been authenticated by the authentication unit as part of a first group having a first predetermined authority providing access to dispensing of the banknotes stored in the loose banknote storage unit and to control the coin-roll storage unit to dispense the coin rolls to replenish the plurality of settlement places only when an operator has been authenticated by the authentication unit as part of a second group having a second predetermined authority, wherein the second predetermined authority is different from the first predetermined authority and provides access to the coin rolls of the storage unit;

a plurality of settlement apparatuses, one settlement apparatus of the plurality of settlement apparatuses being installed in each of the plurality of settlement places and configured to be replenished by the coin rolls and banknotes dispensed from the money handling machine;

a plurality point of sale (POS) registers, a POS register being installed in each of the plurality of settlement places and configured to manage a corresponding settlement apparatus of the plurality of settlement apparatuses; and a judging unit configured to judge whether the total number of the calculated coin rolls to replenish each settlement apparatus coincides with the number of coin rolls dispensed from the money handling machine.

13. A money handling system according to claim 12, wherein the authentication unit is provided in at least one of the settlement apparatus and management apparatus.

14. A money handling system according to claim 12, wherein the judging unit is provided in at least one of the settlement apparatus and management apparatus.

15. A money handling method performed by a money handling machine that includes a coin-roll storage unit configured to store a coin roll and a receiving unit configured to receive information on the coin roll to replenish each of a plurality of settlement places remotely located from the money handling machine, and a loose-banknote storage unit configured to store banknotes in a separate state, the method comprising:

authenticating, by an authentication unit of the money handling machine, an operator as part of a first group having a first predetermined authority providing access to dispensing of the banknotes stored in the loose banknote storage unit or as part of a second group, different from the first group, having a second predetermined authority providing access to the dispensing of the coin roll stored in the coin-roll storage unit when a dispensing process of the money that is to be replenished from the money handling machine to a plurality of settlement places is performed, wherein the second predetermined authority is different than the first predetermined authority;

calculating a total number of the coin rolls to replenish each of the plurality of settlement places based on the information received by the receiving unit from an electrical communication received from the plurality of settlement places;

controlling the coin-roll storage unit so as to dispense the coin roll to replenish the plurality of settlement places at a time, only when the operator is authenticated by the authentication unit as part of the second group having the second predetermined authority and to dispense the number of banknotes at a time when the operator is authenticated by the authenticating unit as part of the first group having the first predetermined authority;

detecting the number of coin rolls dispensed from the coin-roll storage unit; and judging whether the number of coin rolls dispensed from the coin-roll storage unit based on the detected number of coin rolls dispensed from the coin-roll storage unit coincides with the calculated total number of the coin roll to replenish each of the plurality of settlement places.

16. A money handling machine comprising:

a coin-roll storage unit configured to store a coin roll;

an authentication unit configured to authenticate an authority of an operator; and a controlling unit configured to control the coin-roll storage unit so as to dispense the coin roll to replenish a plurality of settlement places at a time only when the authority of the operator authenticated by the authentication unit is a predetermined authority;

a receiving unit configured to receive information on the coin roll to replenish each of the plurality of settlement places;

a cassette mounting unit on which at least one of a plurality of storage cassettes is detachably mounted, each of the plurality of storage cassettes stores money in a separate state and feeds out the money to be stored, wherein the controlling unit calculates a total number of the coin roll to replenish each of the plurality of settlement places based on the information received by the receiving unit, each of the plurality of storage cassettes corresponds to each of the plurality of settlement places, each of the plurality of storage cassettes is provided with a storage medium for storing the information on the coin roll to replenish the corresponding settlement place, and the receiving unit receives the information on the coin roll to replenish each of the plurality of settlement places based on the information read from the storage medium of each of the plurality of storage cassettes.

* * * * *